US005255502A

United States Patent [19]

Iwade et al.

[11] Patent Number: 5,255,502

[45] Date of Patent: Oct. 26, 1993

[54] YARN PIECE METHOD AND YARN PIECING APPARATUS

[75] Inventors: Takashi Iwade, Nara; Tadahiko Okubo, Otsu, both of Japan

[73] Assignee: Toray Engineering Co., Ltd., Osaka, Japan

[21] Appl. No.: 810,350

[22] Filed: Dec. 18, 1991

Related U.S. Application Data

[63] Continuation of Ser. No. 488,995, Mar. 6, 1990, abandoned.

[30] Foreign Application Priority Data

Mar. 7, 1989 [JP] Japan ..... 1-55729

[51] Int. Cl.[5] ..... D01H 15/00

[52] U.S. Cl. ..... 57/22; 57/261

[58] Field of Search ..... 57/22, 92, 261, 263, 57/264, 328

[56] References Cited

U.S. PATENT DOCUMENTS

| | | | |
|---|---|---|---|
| 2,036,441 | 4/1936 | Swanson | 242/18 |
| 2,355,634 | 8/1944 | Doughty | 242/45 |
| 2,402,739 | 6/1946 | Doughty | 242/45 |
| 2,752,105 | 6/1956 | Keith | 242/45 |
| 3,638,872 | 2/1972 | Jennings | 242/18.1 |
| 3,908,920 | 9/1975 | Hermanns | 242/45 |
| 3,911,658 | 10/1975 | Smith | 57/34 R |
| 4,120,140 | 10/1978 | Raasch et al. | 57/263 |
| 4,245,794 | 1/1981 | Hasegawa | 242/45 |
| 4,419,861 | 12/1983 | Fujiwara et al. | 57/261 |
| 4,446,687 | 5/1984 | Mima | 57/261 X |
| 4,500,043 | 2/1985 | Brown | 242/45 |
| 4,634,064 | 1/1987 | Burkhard et al. | 57/263 X |
| 4,711,082 | 12/1987 | Raasch | 57/263 |
| 4,944,145 | 7/1990 | Stahlecker | 57/261 |

FOREIGN PATENT DOCUMENTS

| | | |
|---|---|---|
| 53-134943 | 11/1978 | Japan . |
| 63-176269 | 7/1988 | Japan . |
| 63-243335 | 10/1988 | Japan . |

*Primary Examiner*—Stanley N. Gilreath
*Assistant Examiner*—Michael R. Mansen
*Attorney, Agent, or Firm*—Burns, Doane, Swecker & Mathis

[57] ABSTRACT

In a spun yarn forming textile machine, when a spun yarn delivered from a yarn forming device at a predetermined constant speed and a yarn withdrawn from a yarn package are pieced to each other, a splicer is used to piece together the yarn. After withdrawing a yarn from a yarn package with a predetermined length, the yarn piecing operation is carried out. Rotation of the yarn package is started before the yarn piecing operation is completed. Therefore, snarling can be prevented and the construction of the yarn storing means can be simplified.

2 Claims, 5 Drawing Sheets

YARN PIECE METHOD AND YARN PIECING APPARATUS

This application is a continuation, of application Ser. No. 07/488,995, filed Mar. 6, 1990, now abandoned.

BACKGROUND OF THE INVENTION

1. Field of the Invention

The present invention relates to a yarn piecing method and a yarn piecing apparatus used in textile machines such as open-ended spun yarn spinning machines, and fasciated spun yarn spinning machines and in which a spun yarn spun by and delivered from a yarn forming means and another yarn withdrawn from a yarn package on which the spun yarn is wound are pieced to each other.

2. Description of the Related Arts

Generally speaking, textile machines such as open-ended spun yarn spinning machines or fasciated spun yarn spinning machines include a drafting means, a yarn forming means, a yarn taking-up means, a yarn winding means, and the like. When staple fiber bundles are supplied, a spun yarn such as, a fasciated spun yarn is spun in the yarn forming means and then wound on a yarn package by the yarn winding means.

When a yarn breaks in the yarn producing process, a yarn piecing operation is usually carried out. Namely, the yarn piecing operation includes the steps of stopping a yarn winding means, sucking a spun yarn delivered from a yarn forming means (referred to as a first yarn hereafter) by a first yarn sucking means provided on a yarn piecing apparatus; withdrawing a yarn from a yarn package (referred to as a second yarn hereafter) by a second yarn sucking means; and piecing the first and second yarn to each other by carrying the two yarns to a yarn piecing means.

In this conventional yarn piecing method, a yarn spun by and delivered from a yarn forming means during a yarn piecing operation is sucked and stored in a yarn storing means provided between a yarn taking up means and the yarn piecing means. Then, when the yarn piecing operation is completed, the non-rotated yarn package is restarted to rotate in such a way that the rotational speed thereof is rapidly increased with a predetermined acceleration to take out the yarn stored in the yarn storing means. Thereafter, the rotational speed of the yarn package is changed to a predetermined yarn winding speed to wind up a spun yarn delivered from the yarn forming means.

In this conventional yarn piecing method however, since the rotational speed of the package is increasingly accelerated after the yarn piecing operation is completed, it is required that the total length of the yarn, i.e., the sum of the length of the yarn stored in the yarn storing means when the yarn piecing operation is carried out and the length of the yarn produced during a time from when the yarn package is not rotated to when the rotational speed of the yarn package reaches a predetermined winding speed, (usually requiring 0.5 to 1 second), be sucked and stored in the yarn storing means. Thus, in the conventional method, a yarn storing means having a large yarn storing capacity is necessary.

On the other hand, when such a large capacity yarn storing means is provided on a machine frame, it must be formed in a configuration such that the yarn sucking path is folded several times as shown in Japanese Unexamined Patent Publication (Kokai) No. 53-134943, making it difficult to make such a yarn sucking means.

When a yarn piecing operation is carried out utilizing a knotter, the time required to piece yarns is very short, for example, 0.1 to 0.3 second, therefore, the yarn can be sufficiently stored in the yarn storing means without providing a yarn storing means having a relatively longer length. When a yarn piecing operation is carried out utilizing a splicer, however, the time required for piecing yarns is usually 0.4 to 0.7 second, longer than the previous method. Accordingly, the amount of yarn stored in the yarn storing means is increased.

Therefore, a yarn storing means having an extremely large capacity for storing yarn is required to be provided when intending to store the yarn produced during the time in which the rotational speed of the yarn package reaches a predetermined yarn winding speed from a non-rotated condition and the yarn produced during the yarn piecing operation.

However, it is very difficult to make a yarn storing means having such a large capacity, and it is also very difficult to find a place on a textile machine on which such a large capacity yarn storing means may be mounted. Thus, it is impossible to use this kind of yarn storing means in actual production.

Further, since yarn existing between the yarn piecing means and the yarn package cannot be wound on the yarn package under a predetermined yarn tension simultaneously with completion of the yarn piecing operation, a snarling naturally occurs in the yarn in the yarn piecing means and therefor a problem arises in that snarls are easily wound onto the yarn package with a normal spun yarn.

SUMMARY OF THE INVENTION

The object of the present invention is to shorten the length of the yarn storing means and to make it easy to produce the yarn storing means.

A second object of the present invention is to provide a conventional textile yarn forming machine having a yarn piecing device utilizing a knotter enabling piecing of yarns with a splicer instead of a knotter.

The third object of the present invention is to prevent snarling in a yarn package.

To attain the objects of the present invention as explained above according to one aspect of the invention, there is provided a yarn piecing method in which a first yarn, spun by and delivered from a yarn forming device at a predetermined constant speed, and a second yarn, withdrawn from a yarn package on which the yarn is wound, are pieced to each other, the yarn piecing method comprising the steps of withdrawing the second yarn from the yarn package by a predetermined length, piecing the second yarn with the first yarn, and starting rotation of the yarn package before a yarn piecing operation is completed.

According to another aspect of the present invention, there is provided a yarn piecing apparatus which comprises a unit traveling along a machine frame provided with at least a yarn forming means and yarn winding means thereon, the traveling unit being provided with at least a yarn piecing means, a first-yarn sucking means, a second-yarn sucking means, a yarn package driving means, and a second-yarn picking-up means, characterized in that a yarn storing means is further provided on the traveling unit located at a portion between the yarn piecing means and the yarn winding means provided on the machine frame.

BRIEF DESCRIPTION OF THE DRAWINGS

FIGS. 5-1 through 5-8 are schematic views explaining the sequential yarn piecing operation of the present invention.

DESCRIPTION OF THE PREFERRED EMBODIMENTS

Figure 1:
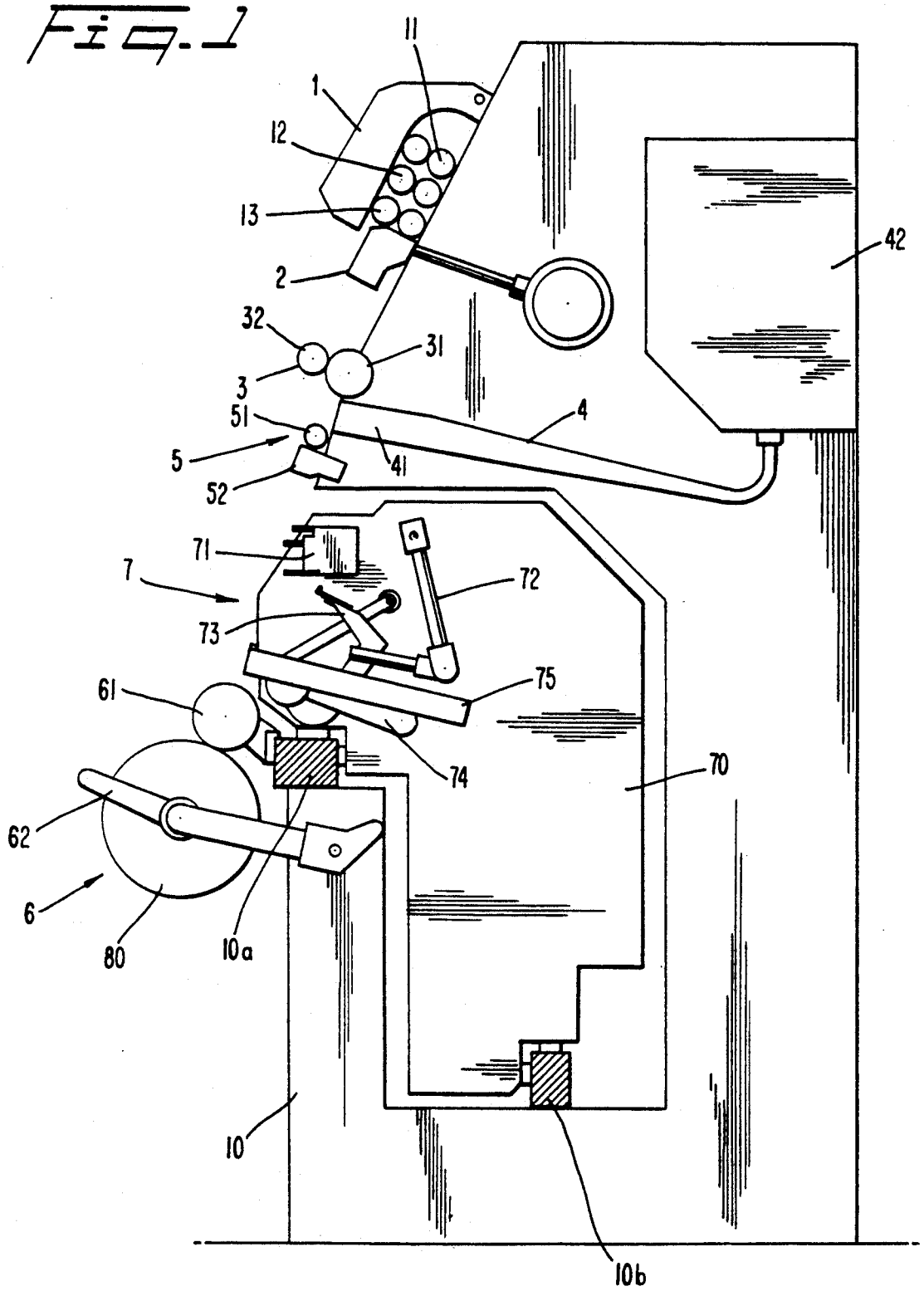
FIG. 1 is a cross-sectional view of one embodiment of a yarn piecing apparatus of the present invention used on a spun yarn producing machine.

An embodiment of the present invention will be explained with reference to the drawings hereunder.

This embodiment relates to a textile machine with a yarn piecing means thereon. A drafting means 1 including back rollers 11, middle rollers 12 and front rollers 13 is provided on a machine frame 10.

Note that in the drafting means 1, the back rollers 11 are provided with a stopping mechanism for stopping rotation by separating the rollers from a driving shaft (not shown).

A yarn forming means 2 is also provided in the machine frame 10 adjacent to the front rollers 13 of the drafting means 1. A staple fiber bundle delivered from the front rollers 13 is sucked into it and formed into a fasciated spun yarn, for example, by applying whirling force generated by compressed air onto the staple fiber bundle.

A yarn forming means as shown in Japanese Unexamined Patent Publication No. 63-243335 can be used in the present invention.

A yarn taking-up means 3 is also provided. It is arranged underneath the yarn forming means 2 with a predetermined space therebetween.

The yarn taking-up means 3 includes a driving roller 31 and a nip roller 32 having a small width. One end of the rotating shaft thereof is supported by a suitable bearing. The means 3 can take up a spun yarn delivered from the yarn forming means 2 at a predetermined speed.

A yarn storing means 4 is provided and arranged underneath and adjacent to the yarn taking-up means 3.

The yarn storing means 4 includes a yarn sucking tube 41 having a substantially flat rectangular cross-sectional configuration. One end is opened to a position through which the spun yarn passes while the opposite end is connected to a pneumatic duct 42 with a negative pressure source (not shown).

A tensioning means 5 for applying a suitable tension to a spun yarn is provided underneath the yarn storing means 4 and includes a yarn tenser 51, a cutter, a slub catcher, or the like.

A yarn winding means 6 is provided underneath the yarn tensioning means 5 and includes a driving roller 61 connected to a line shaft through a clutch mechanism and provided with a groove on a peripheral surface thereof for traversing a yarn to be wound on a package and a cradle, rotatably supporting a yarn bobbin and having a pressuring means whereby the yarn bobbin is attached to a surface of the driving roller 61 with a predetermined surface pressure to wind the spun yarn delivered from the yarn taking-up means 3 on the yarn bobbin.

Usually, a yarn producing unit includes a drafting means 1, a yarn forming means 2, a yarn taking-up means 3, a yarn storing means 4, a yarn tensioning means 5, and a yarn winding means 6, and a plurality of the yarn producing units are arranged in a longitudinal direction of a textile machine frame 10 with a predetermined space therebetween.

On the other hand, a yarn piecing apparatus 7, i.e., a traveling unit, is provided in the machine frame 10 and travels along rails **10*a* and 10*b* arranged in a longitudinal direction of the machine frame 10** to piece yarns on a yarn producing unit in which yarn breakage occurs.

Note that when yarn breakage occurs, a first yarn delivered from the yarn forming means 2 and a second yarn withdrawn from a yarn package 80 on which a spun yarn is wound are pieced to each other.

A detailed description of the yarn piecing apparatus will be explained hereunder with reference to FIGS. 2 and 3.

Figure 2:
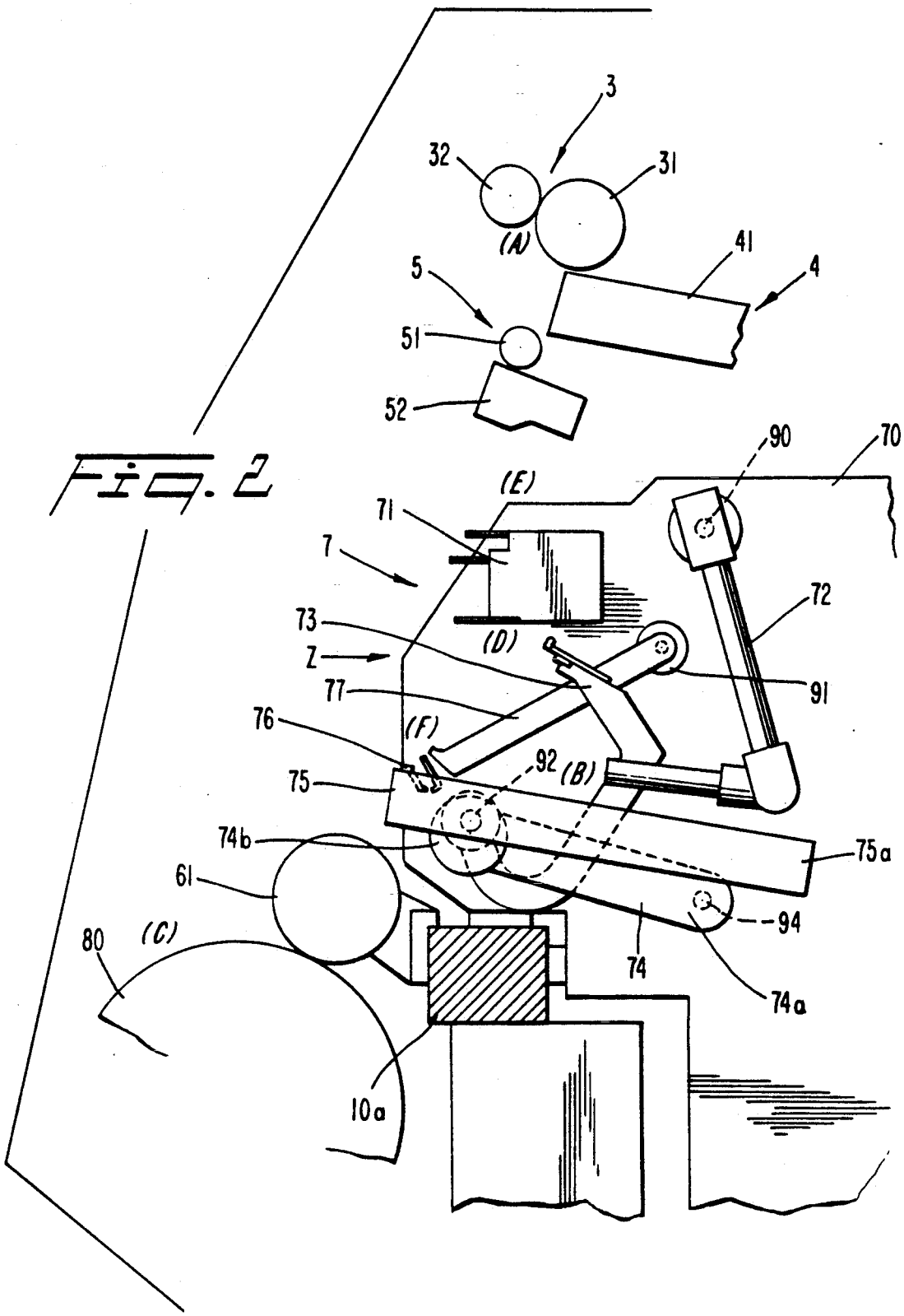
FIG. 2 is an enlarged cross-sectional view of the yarn piecing apparatus shown in FIG. 1.

In FIG. 2, a splicer 71 is provided on the traveling unit 70 and arranged between the tensioning means 5 and yarn winding means 6 as explained above to piece a first yarn delivered from the yarn forming means 2 and a second yarn withdrawn from a yarn package on which a spun yarn is wound.

The splicer 71 is fixedly mounted on a traveling unit 70 by a bracket 93 and includes a yarn guiding plate for guiding a yarn to a predetermined place at which the yarn piecing operation will be carried out, yarn gripping needles for gripping the first and the second yarn, and a yarn piecing means.

A first-yarn sucking means 72 is provided pivotally mounted on the traveling unit 70, it swings around a rotating rod 90 having a hollow tube 96 therein, one end thereof being connected to a negative pressure source (not shown), for example, a blower.

The other end of the hollow tube 96 is connected to an opening portion 95 of the first yarn sucking means 72 to form a yarn sucking aperture.

The sucking aperture can move between a yarn sucking portion (A) beneath the yarn taking-up means 3 and a waiting portion (B) beneath the yarn splicer 71 so the yarn delivered from the yarn taking-up means 3 is sucked into the sucking means 72 as a first yarn and thus the first yarn is carried to a yarn piecing portion of the splicer 71.

A second-yarn sucking means 73 is provided pivotally mounted on the unit 70. It swings around a rotating rod 92 having a hollow tube 97 therein, one end thereof being connected to a negative pressure source (not shown), for example, a blower.

The other end thereof is formed as a yarn sucking aperture 98 having the same width as that of the yarn packagae and is connected to a negative pressure source as mentioned above through the hollow tube 97.

The sucking aperture 98 thereof can move between a yarn sucking portion (C) adjacent to a yarn package 80 provided on a cradle 62 and a waiting portion (D) beneath the yarn splicer 71.

In the present invention, a roller driving means 74 is provided and includes an arm **74*a* pivotally mounted on the unit 70, utilizing a bearing means, a roller 74*b* rotatably mounted on one end of the arm 74*a*, a cylinder for rotating the arm 74*a*** (not shown), and an electric motor such as an induction motor, or a pulse motor (not shown) for rotating the roller both forward and reverse.

Therefore, the driving roller 61 of the yarn winding means 6 can be rotated both forward and reverse.

A yarn storing means 75 is provided on the traveling unit arranged between the yarn winding means 6 and the yarn splicer 71 and includes a yarn sucking tube 75*a*, one end thereof being close to a yarn passage, being cut and opened to form a yarn sucking aperture, while the longitudinal direction thereof being perpendicular to a yarn traveling direction which is vertical, and another end of the yarn sucking tube 75*a* is connected to a negative pressure source (not shown), for example, a blower.

A yarn gripping means 76 is also provided on the unit 70 and arranged adjacent to an upper portion of the yarn storing means 75.

Figure 4:
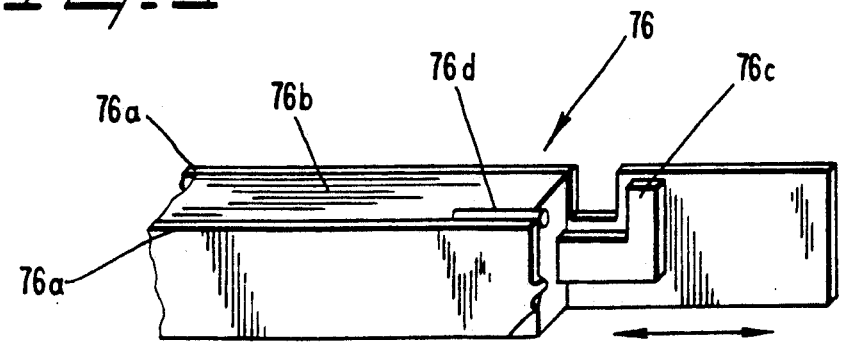
FIG. 4 is a schematic view of the yarn gripping means used in the present invention.

As shown in FIG. 4, the yarn gripping means 76 includes a supporting means 76*a*, a solid portion 76*b* for gripping yarns fixedly mounted on the supporting means 76*a*, a movable portion 76*c* for gripping yarn and slidably mounted on the solid portion 76*b* and operated by an electric actuator (not shown), and a detector 76*d* for detecting a yarn. When a yarn withdrawn from the yarn package 80 is detected, the yarn is gripped by the yarn gripping means 76.

Accordingly, when the package 80 is rotated in the reverse direction, the yarn is sucked by and stored in the sucking tube 75 of the yarn storing means 73.

A yarn picking-up means 77 is further provided pivotally mounted on the unit 70 through a rotatable rod 91. It can move between a yarn pulling up position (E) above the yarn splicer 71 and a waiting position (F) beneath the yarn sucking means 75*a* in a accordance with a rotation of the rod 91, whereby a yarn between the yarn gripping means 76 and the second yarn sucking means 72 can be picked up and carried to a yarn piecing portion of the splicer 71.

The yarn is withdrawn from the package by rotating it in an opposite direction to the normal yarn winding direction with the roller driving means 74. The yarn length (L) stored in the yarn storing means 75 at that time must be the sum of the yarn length ($l_1$) wound on the yarn package during a time in which the rotation of the yarn package reaches a predetermined speed from the non-rotated condition and a yarn length ($l_2$) corresponding to an error.

The yarn length ($l_2$) should be determined taking into account the accuracy of the electric motor of the roller driving means 74 or inverter for controlling the rotation of the motor and the variation of the yarn length withdrawn from the package depending upon a diameter of the yarn package 80, yarn traversing position, yarn traversing width, or the like.

Therefore, when a pulse motor is used as a roller driving means, the length ($l_2$) can be reduced and can be set at the range of 10 to 50 cm.

The acceleration when the rotational speed of the yarn package is increased from the non-rotated condition to a predetermined yarn winding speed is preferably set at the maximum extent at which slippage does not occur between the roller 74*b* supported by a swing arm 74*a* of the roller driving means 74 and the driving roller 61 of the yarn winding means 6 or between the driving roller 61 and the yarn package 80.

The swing arm 74*a* is pivotably mounted on a rotatable rod 94 whereby the arm 74*a* can be swung in accordance with rotation of the rod 94.

In the present invention, a yarn piecing operation can be carried out with the same timing regardless of the yarn package size being small or large, by keeping the yarn length stored in the yarn storing means 75 constant and setting a driving force for driving the roller driving means 74 and a time for increasing the rotational speed of the package from a non-rotated condition to a predetermined rotational speed so as to keep the acceleration of the package constant regardless of the package size.

Measurement of yarn length stored in the yarn storing means can be carried out by counting the rotation of the roller driving means 74 or by a yarn detector provided at a predetermined position in the yarn storing means 75.

On the other hand, the timing for energizing the splicer may be varied depending upon the difference of acceleration of the yarn package keeping the yarn length stored in the yarn storing means constant.

The drafting means 1, the yarn winding means 6, and the yarn piecing means 7, are controlled by a controlling means comprising an input circuit for setting operations, a memory circuit, a comparator, a processing circuit, a operation directing circuit, or the like (not shown), or a microcomputer.

When yarn breakage occurs during a yarn forming operation and yarn winding operation in the spun yarn spinning machine as explained above, first the rotation of the back rollers 11 in the drafting means 1 is stopped in response to a signal generated from a controller (not shown), whereby delivery of a spun yarn from the yarn forming means 2 is interrupted. Rotation of the yarn package 80 is stopped due to the driving roller 61 being removed from a line shaft by actuating a clutch (not shown).

Then, when the yarn piecing apparatus 7 is moved to the yarn producing unit on which the yarn breakage occurred, the yarn piecing operation is carried out along sequential steps shown in FIGS. 5-1 through 5-8 in turn.

First, when the first yarn sucking means 72 is rotated and the sucking aperture thereof is moved to the position (A) beneath the yarn taking-up means 3, the drafting means 1 is restarted to supply a staple fiber bundle to the yarn forming means 2, whereby a fasciated spun yarn or open-ended spun yarn is spun out therefrom and delivered from the yarn taking-up means 3 at a predetermined speed.

Next, the yarn delivered from a point formed between the driving roller 31 and the nip roller 32 is sucked by the yarn sucking aperture as a first yarn.

Simultaneously with the operational movement as mentioned above, the second yarn sucking means 73 is rotated and the aperture thereof is moved to a position (C) for sucking the second yarn above the yarn package 80 while the roller driving means 74 is actuated, whereby the arm 74*a* is rotated enabling the roller 74*b* to be contacted to the drive roller 61 of the yarn winding means 6.

Therefore, the yarn package 80 is rotated in an opposite direction to the yarn winding direction with the driving roller 61.

Figures 4, 5:
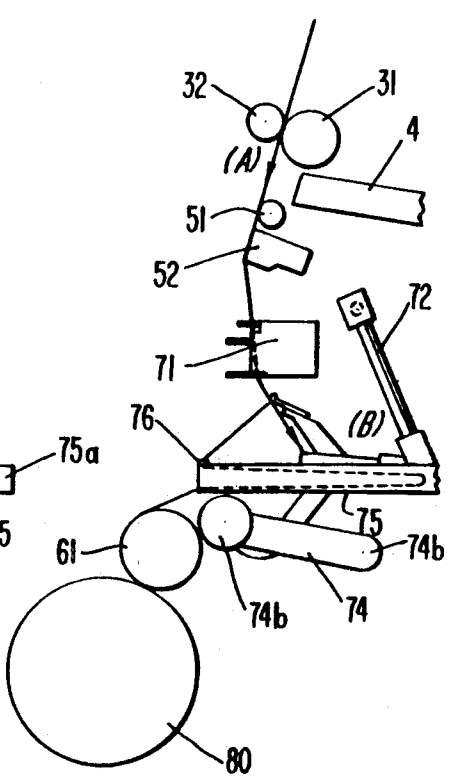
Figures 3, 5:
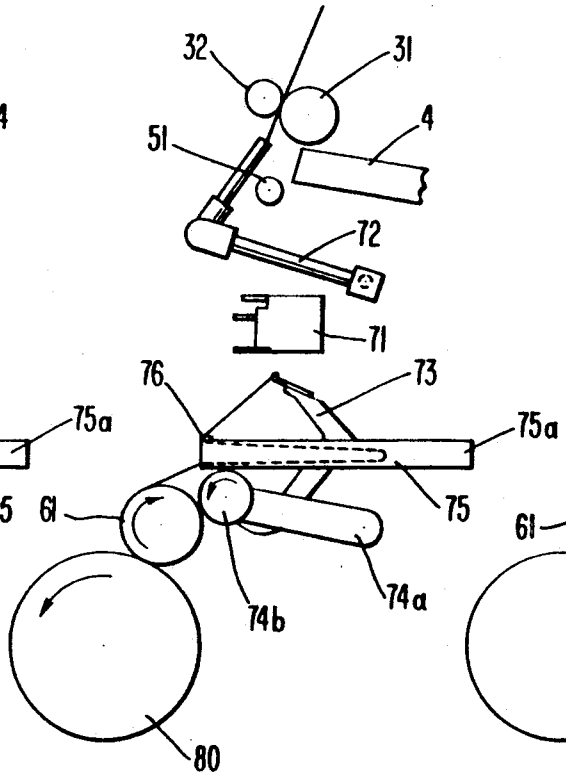
Figures 2, 5:
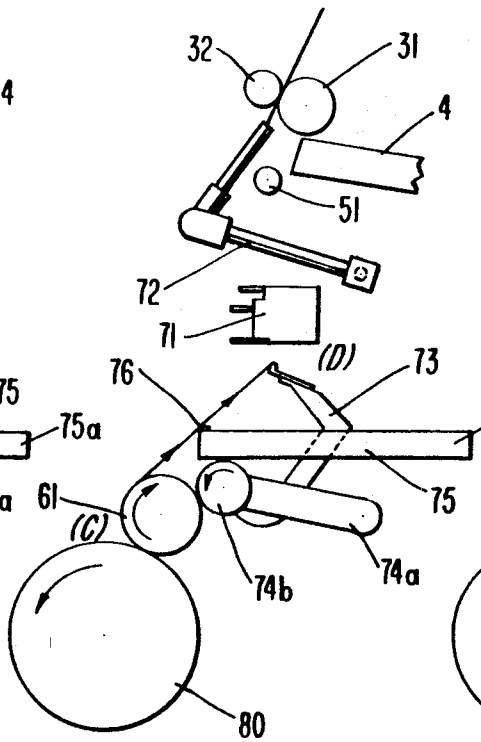
Figures 1, 5:
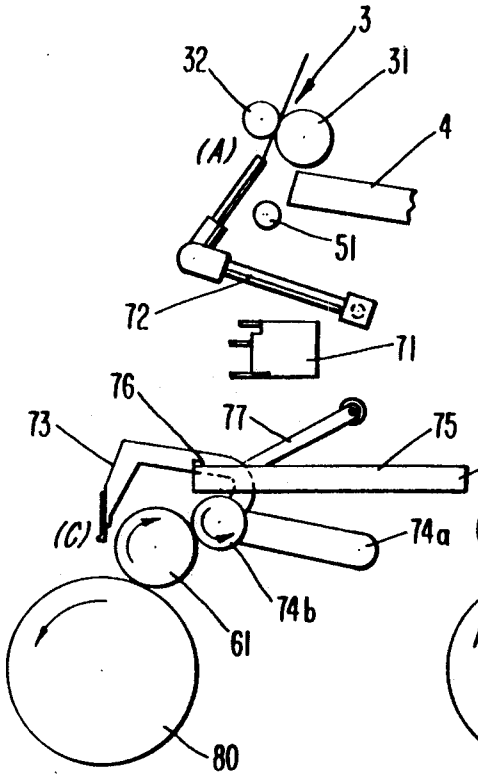

After that, an end of the yarn contacting a peripheral surface of the yarn package is sucked into the yarn sucking aperture (shown in FIG. 5-1).

When the yarn is withdrawn from the yarn package 80 as a second yarn, the second yarn sucking means 73 is rotated to move back the yarn sucking aperture to a waiting position (D) (shown in FIG. 5-2).

After this, when the yarn is detected by the yarn detector 76*d* of the yarn gripping means 76, an electromagnetic actuator (not shown) is actuated to withdraw the movable portion 76c, whereby the yarn is fixedly gripped between the movable portion 76c and the solid portion 76b.

During these operations, the yarn package is continuously rotated, whereby a certain amount of the yarn is withdrawn from the yarn package 80.

Figure 3:
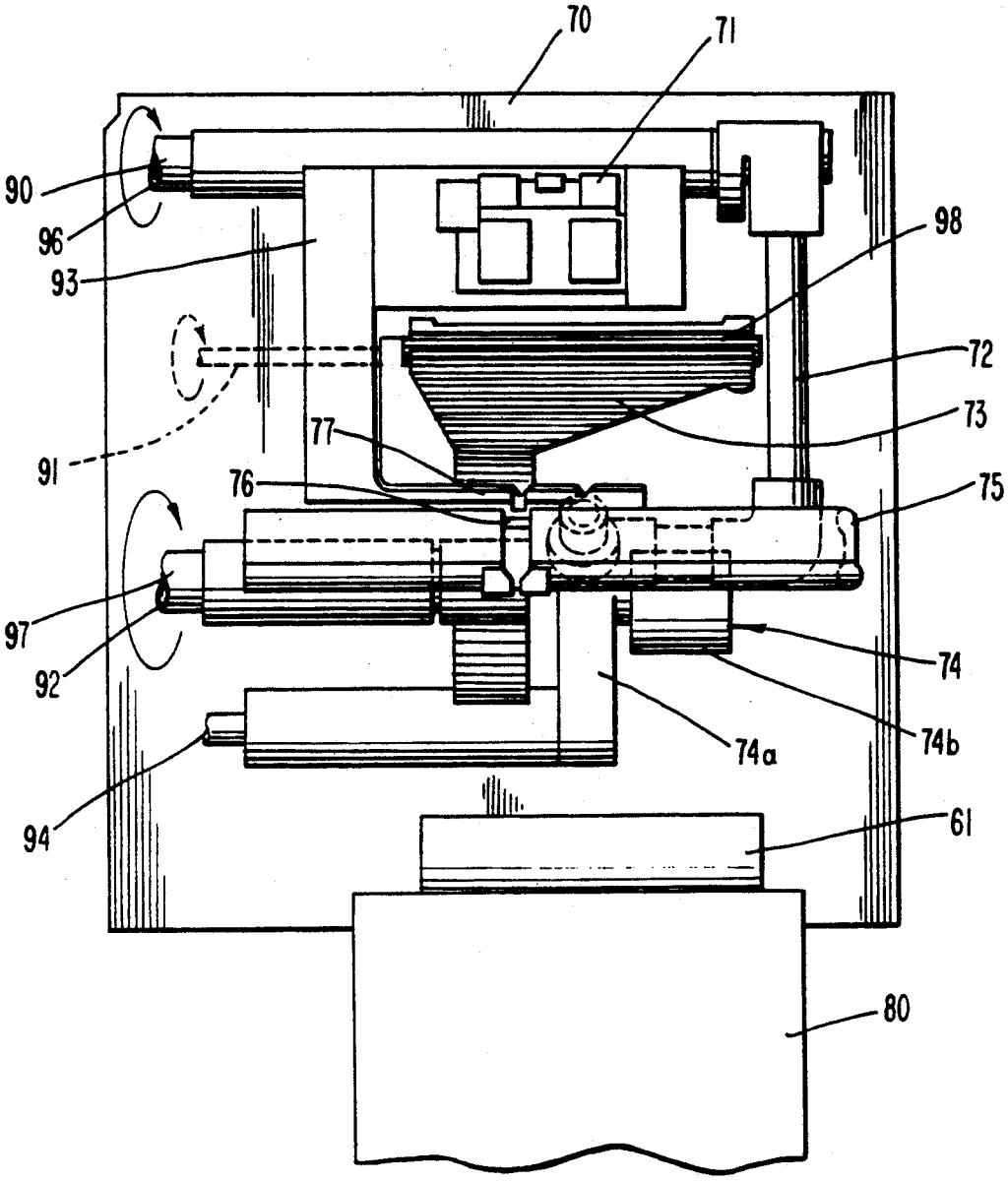
FIG. 3 is a front plane view of the yarn piecing apparatus taken from a direction indicated by an arrow Z shown in FIG. 2.

Accordingly, the yarn withdrawn from the yarn package 80 is sucked into the yarn sucking tube 75a of the yarn storing means 75 through an aperture thereof and stored in the yarn storing means in a U-like form (shown in FIG. 5-3).

During the operation as shown in FIG. 5-3, the first-yarn sucking means 72 is rotated to move back the sucking aperture to the waiting position (B), thereby the yarn is carried to a yarn piecing portion of the splicer 71.

On the other hand, when a predetermined yarn length (L) is sucked into the yarn sucking tube 75a due to the reverse rotation of the yarn package 80, the roller driving means 74 is actuated to stop the rotation of the roller 74b (shown in FIG. 5-4).

The yarn carried to the yarn piecing portion of the splicer 71 in the operation as above is fixedly gripped by a gripping needle (not shown).

Therefore, the yarn delivered from the yarn taking-up means 3 is sucked into the yarn storing means 4 in a U-shaped form.

After that, the yarn between the yarn gripping means 76 and the sucking means 75a is picked up by the rotating yarn picking-up means 77 to carry the yarn to the position (E) located above the splicer 71, whereby a part of the yarn can be carried to the yarn piecing means, i.e., a splicer 71.

When the yarn picking-up means 77 is rotated, the roller driving means 74 is actuated simultaneously with or before the rotation of the yarn picking-up means, so the yarn package can be rotated in a yarn winding direction by the driving roller 61 of the yarn winding means 6 due to the rotation of the roller 74b.

At this time, the yarn package 80 is rotated with a predetermined acceleration when the package is started to rotate from the non-rotated condition and to the condition at which the package is rotated at a predetermined speed. (This acceleration means the maximum acceleration not causing any slippage between the roller 74b and the driving roller 61 or between the driving roller 61 and the yarn package 80.) The yarn stored in the yarn storing means 75 is withdrawn therefrom gradually and wound on the yarn package again.

Then, when the splicer is actuated, the first yarn delivered from the yarn taking-up means 3 and the second yarn withdrawn from the yarn package 80 are pieced to each other (shown in FIG. 5—5).

When the yarn piecing operation by the yarn splicer 71 is completed, the yarn gripping means 76 is simultaneously actuated to project the movable portion 76c, whereby the yarn gripped by the yarn gripping means is released.

Up to this time, the yarn previously stored in the yarn storing means 75 is mostly wound up on the yarn package 80 and no yarn remains therein.

Figures 5, 6, 7, 8:
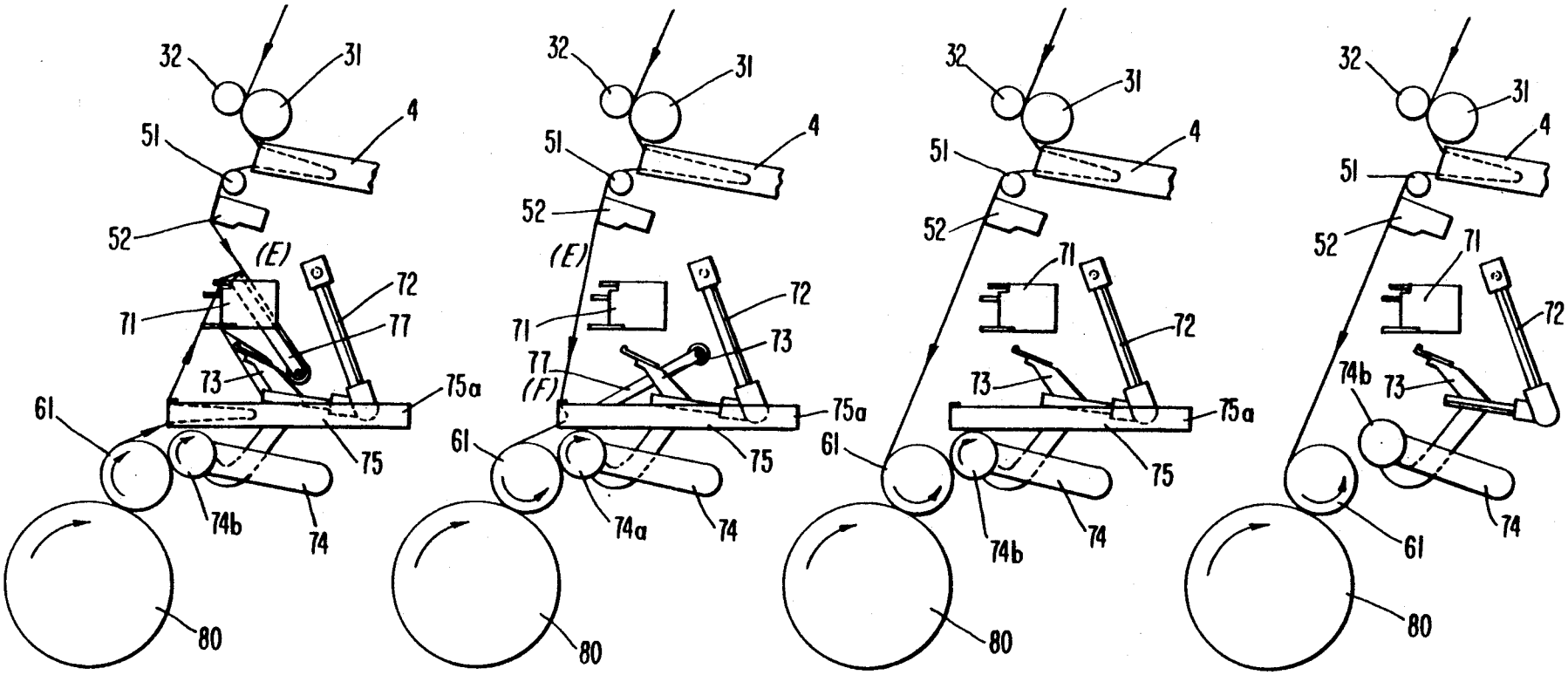

While, in the present invention, no snarling will occur in the yarn piecing means because a suitable yarn tension is stably applied to the yarn between the splicer 71 and the yarn package 80 by the yarn storing means 75 (shown in FIG. 5-6).

When all the yarn stored in the yarn storing means 75 is wound on the package, a yarn winding operation of the yarn stored in the yarn storing tube 4 is started.

At this time, the rotating speed of the yarn package 80 already reaches a predetermined yarn winding speed (shown in FIG. 5-7).

When the yarn piecing operation as explained above is completed, the roller driving means 74 is actuated to rotate the arm 74a and to remove the roller 74b from the package 80, while the clutch of the yarn winding means 6 is actuated to couple the driving roller 61 with the line shaft, whereby the normal yarn winding operation is carried out.

Thus, since the yarn of the yarn package can be wound with a predetermined winding tension simultaneously with the completion of the yarn piecing operation, no snarling occurs in the yarn in the yarn piecing means.

Generally speaking, since the yarn winding speed of the yarn winding means 6 is faster by 2 to 3% than the yarn delivering speed of the yarn taking-up means 3, the yarn stored in the yarn storing means 4 during the yarn piecing operation, can be wound on the yarn package 80 (shown in FIGS. 5-8).

According to the yarn piecing method of the present invention, in the case of a yarn spun out from a yarn forming means at a constant speed and pieced with a yarn withdrawn from a yarn package on which a yarn was wound, first a yarn piecing operation is carried out by withdrawing a predetermined amount of yarn from the yarn package and the package is rotated with a certain acceleration before the yarn piecing operation is completed.

Therefore, the yarn can be wound on the yarn package simultaneously with the completion of the yarn piecing operation, enabling shortening of the length of the yarn storing means mounted on the machine frame and facilitating production of the same.

On the other hand, since the rotational speed of the yarn package reaches a desired yarn winding speed at the time when the yarn piecing operation is completed, yarn piecing operation utilizing a splicer can be carried out during the time in which the rotational speed of the yarn package is increased from the non-rotated condition to the predetermined rotational speed and thus a yarn piecing operation with a splicer is possible by reforming a conventional textile machine provided with a knotter as a yarn piecing means.

Further, in accordance with the yarn piecing method of the present invention, occurrence of snarling can be effectively prevented on a yarn in the yarn piecing means because a suitable yarn tension is applied to the yarn between the yarn piecing means and the yarn package by the yarn storing means and the yarn can be wound on the package at predetermined yarn winding tension simultaneously with the completion of the yarn piecing operation.

In the yarn piecing method as explained above, the yarn piecing operation can be stably carried out by effecting the following:

storing a yarn withdrawn from a yarn package in a yarn storing means provided between a yarn piecing means and the yarn package;

winding again the yarn withdrawn from the yarn package on the yarn package on or just after the completion of the yarn piecing operation:

making the amount of yarn withdrawn from the yarn package and stored in the yarn storing means constant regardless of a winding diameter of the yarn package; and making an acceleration ratio to rotate the yarn package approximately constant regardless of a winding diameter of the yarn package.

The yarn piecing method as mentioned above can be carried out by utilizing a yarn piecing apparatus mounted on a traveling unit moving along a machine frame and including a yarn piecing means, a first-yarn sucking means, a second-yarn sucking means, a roller driving means, and a yarn picking-up means. The yarn piecing apparatus may be further provided with a yarn storing means used for the yarn piecing operation on the traveling unit arranged between the yarn piecing means and the yarn winding means provided on the textile machine frame.

EXAMPLE

First embodiment of the present invention will be explained hereunder.

A roller driving means 74 driven by a motor is provided in a yarn piecing apparatus and an arm 74*a* is pressed by a fluid cylinder with a predetermined pressure causing a roller 74*b* of the roller driving means 74 to be pressed against a driving roller 61.

The driving roller 61 has a clutch inside thereof and thereby the driving roller 61 can rotate freely due to the driving roller being separated from a driving shaft when a yarn piecing operation is carried out.

On the other hand, when the driving roller is accelerated, a cradle 62 is swang by the fluid cylinder to press a package 80 against the driving rolle 61 with a pressure of 6 kg which is higher than that in a normal yarn winding operation to rotate the roller 74 and thus the package 80 is rotated by the driving roller 61.

In this embodiment, a friction coefficiency between the package 80 and the driven roller 61 is about 0.18 and accordingly, a driving force (T) on a surface of the package 80 which is transferred from the driving roller 61 to the package 80 will be 1.08 kg (6 kg×0.18=1.08 kg).

While, an inertial force $GD^2$ of a bobbin, a package and a driving roller respectively will be given as follows;

| Item | Diameter | $GD^2$ |
|---|---|---|
| Bobbin | 60 mm | 0.00015 $kgm^2$ |
| Package | 150 mm | 0.011808 $kgm^2$ |
| Package | 280 mm | 0.146831 $kgm^2$ |
| Package | 300 mm | 0.193595 $kgm^2$ |
| Driving roller | 82 mm | 0.0048 $kgm^2$ |

And when a winding seed is 185 m/min. a rotation number of the bobbin, the package and the driving roller respectively will be given as follows;

| Item | Diameter | R.P.M. |
|---|---|---|
| Bobbin | 60 mm | 981 R.P.M. |
| Package | 150 mm | 392 R.P.M. |
| Package | 280 mm | 210 R.P.M. |
| Package | 300 mm | 196 R.P.M. |
| Driving roller | 82 mm | 718 R.P.M. |

an accelerated time for the package 80 (a rising up time for the yarn winding speed) having a maximum torque without occurring a slip between the package 80 and the driving roller 61, can be calculated utilizing the data as follows;

| Item | Diameter | Accelerated time |
|---|---|---|
| Bobbin | 60 mm | 0.01 sec |
| Package | 150 mm | 0.15 sec |
| Package | 280 mm | 0.54 sec |
| Package | 300 mm | 0.62 sec |

Note, that the accelerated time (a rising up time for the yarn winding speed) will become maximum when the diameter of the package is 300 mm in which the rotational number is minimum while the $GD^2$ is maximum.

Accordingly, regarding the accelerated time of the package (a rising up time for the yarn winding speed), when the package is accelerated linealy from 0 m/min to 185 m/min with more than 0.62 seconds, the slippage between the package 80 and the driving roller 61 will be prevented and thereby the yarn winding speed on the package can be risen with the same accelerating speed from one package condition the diameter thereof being 60 mm to another package condition the diameter thereof being 300 mm.

In the yarn piecing apparatus of this embodiment, when driving motor requires a voltage source having a frequency of 60 Hz at a time when the driving roller 61 rotates at a rotational speed of 185 m/min, the yarn winding speed is risen linealy within 0.62 seconds by changing the frequency of the driving motor from 0 Hz to 60 Hz utilizing an inverter.

In a practical operation in the apparatus above, the actual accelerated time of the package (a rising up time for the yarn winding speed) may be set at around 0.7 second taken errors into the account not to reduce the actual accelerated time of the package below 0.62 seconds.

Second embodiment of the present invention may be considered as follows;

When the yarn storing means has a sufficient sensibility, a feed back control is not required, although in order to improve its accuracy, a feed back control may be adopted in which a frequency of an inverter is changed with response to a detected signal with respect to a rotation number of an output axis of a motor.

Alternatively, another method may be used in which a DC motor is utilized and the voltage to be supplied thereto may be changed in accordance with a detected rotational speed of the motor or in which a pulse motor, a survo-motor or the like is used.

The third embodiment of the present invention may be considered as follows;

In the previous embodiment, a method in which the yarn winding speed will be risen with a constant accelerated speed, is disclosed, although another method may also be used in which a torque of the driving motor for the driving roller 61 is set at a constant level and utilizing an amount of a yarn withdrawn from the yarn storing means corresponding to an amount of a yarn stored in the yarn storing means, calculated from the accelerated time as mentioned above, as a reference, a large amount of yarn is stored in the yarn storing means when the diameter of the package is small, while a small amount of yarn is stored therein when the diameter of the package is large.

In this method above, however, a means for detecting a diameter of the package is necessary and further since the accelerated time of the package (a rising up time for the yarn winding speed) is relatively high when the diameter of the package is small, when the condition of the accelerated time thereof is set at the same condition as that of the package having a large diameter, the amount of the yarn stored in the yarn storing means should be increased and thus the total length of the yarn storing means 75 should be enlarged with respect to that used in a method in which a constant accelerated speed is used.

The fourth embodiment of the present invention also may be considered as follows;

Further, there is another method in which the accelerated speed can be calculated by measuring a yarn length (yarn length stored in the yarn storing means) which is withdrawing from the yarn storing means 75.

This method, however, will be resulted in the same method as that in which a constant accelerated speed is utilized if the package is accelerated under a condition such as no slippage will occur between the package 80 and the driving roller 61.

We claim:

1. A yarn piecing apparatus comprising a unit traveling along a machine frame provided with at least a yarn forming means and yarn winding means thereon, said unit being provided with at least a yarn piecing means for performing a yarn piecing operation in which first yarn withdrawn from the yarn forming means is pieced to second yarn withdrawn from the yarn winding means, a first-yarn sucking means for withdrawing first yarn from the yarn forming means, a second-yarn sucking means for withdrawing second yarn from the yarn winding means, a yarn package driving means, and a second-yarn picking-up means, and including first-yarn storing means for storing first yarn withdrawn from said yarn forming means, said first-yarn storing means being disposed between the yarn forming means and the yarn piecing means, and second-yarn storing means provided on said unit between said yarn piecing means and said yarn winding means for storing second yarn withdrawn from said yarn winding means, and including second-yarn gripping means located at an upper portion of said second-yarn storing means for gripping the second yarn withdrawn from the yarn winding means until completion of the yarn piecing operation.

2. The apparatus according to claim 1, wherein said second-yarn gripping means includes a yarn detector for detecting the second yarn to thereby signal to an actuator that the second-yarn gripping means is to be actuated for purposes of gripping the second yarn.

* * * * *